United States Patent [19]

Aoki et al.

[11] Patent Number: 4,582,440

[45] Date of Patent: Apr. 15, 1986

[54] LINE SPACING DEVICE FOR AN OFFICE MACHINE

[75] Inventors: Hideo Aoki; Masami Hayakawa, both of Kodaira, Japan

[73] Assignee: Silver Seiko Ltd., Kodaire, Japan

[21] Appl. No.: 447,702

[22] Filed: Dec. 7, 1982

[30] Foreign Application Priority Data

Dec. 14, 1981 [JP] Japan ..... 56-184871

[51] Int. Cl.[4] ..... B41J 19/92; B41J 19/84

[52] U.S. Cl. ..... 400/574.1; 400/568; 400/575.1; 400/575.2

[58] Field of Search ..... 400/574, 574.1, 572, 400/575, 575.1, 575.2, 568

[56] References Cited

U.S. PATENT DOCUMENTS

| | | | |
|---|---|---|---|
| 3,197,012 | 7/1965 | Lambert | 400/575.1 |
| 3,272,303 | 9/1966 | Pohl | 400/550 |
| 3,763,987 | 10/1973 | Kunst et al. | 400/575.2 |
| 4,365,904 | 12/1982 | Mueller et al. | 400/568 |
| 4,376,585 | 3/1983 | Fromme et al. | 400/568 |
| 4,383,778 | 5/1983 | Costa | 400/568 |

FOREIGN PATENT DOCUMENTS

| | | | |
|---|---|---|---|
| 0038216 | 10/1981 | European Pat. Off. | 400/568 |
| 385756 | 9/1973 | U.S.S.R. | 400/574.1 |

*Primary Examiner*—Edgar S. Burr

*Attorney, Agent, or Firm*—Pahl, Lorusso & Loud

[57] ABSTRACT

An automatic line spacing device which can be advantageously incorporated in typewriters, especially of the type which has no constantly rotating power shaft. A feed pawl is mounted on a rockable member and cooperates with a ratchet to angularly rotate a typewriter type platen. The rockable member is constantly coupled to a bidirectional electric motor which is first energized sufficiently to angularly rotate the rockable member from its home position to a rotated limit position defined by a fixed positive stop element for effecting a line spacing operation and then secondly energized sufficiently to rotate the rockable member back to its home position as defined by another stop element. A cam adjusts the angle during which the feed pawl engages the ratchet so as to effect different line spacing increments.

19 Claims, 3 Drawing Figures

LINE SPACING DEVICE FOR AN OFFICE MACHINE

BACKGROUND OF THE INVENTION

This invention relates to a line spacing device for a typewriter, and more particularly to an automatic line spacing device which includes a ratchet wheel mounted for integral rotation with a cylinder platen, and a feed pawl mounted for engagement with the ratchet wheel for incrementally feeding a paper sheet carried on the platen.

Automatic line spacing devices for electrically operated typewriters are already known which include a ratchet wheel mounted for integral rotation with a cylinder platen and a feed pawl mounted for engagement with the ratchet wheel for incrementally feeding a paper sheet carried on the platen. Conventionally, most of such typewriters include a constantly rotating power shaft coupled to an electric motor, which is in most cases an AC motor, and the power shaft is operatively coupled to the feed pawl of such line spacing devices by way of a suitable motion converting means for converting the rotational motion of the power shaft into a linear or circular or any other suitable reciprocating motion of the feed pawl. The motion converting means may conventionally include a cycle clutch mechanism or an eccentric cam mechanism and an associated link mechanism.

Recently, "daisy wheel" typewriters have been so popular that less and less effort is made to develop power driven typewriters of any other conventional type, such as a "type bar" type. The daisy wheel typewriters normally have no such constantly rotating power shaft and include a daisy wheel type wheel which is conventionally coupled to either a stepping motor or a servomotor for rotating the type wheel to bring a selected character type to a print position for printing. Normally, in these typewriters, a separate slectric motor is provided for a ribbon mechanism and for a line spacing function and/or an escapement or spacing function.

Conventionally, a stepping motor is used for the line spacing function which is constantly coupled to the platen by way of a transmission including several toothed gear elements such that a fraction or step of rotation of the motor in either direction will cause a smaller fraction of rotation of the platen in a corresponding direction. Employment of the stepping motor is advantageous in that it eliminates the use of complicated motion converting structure typically including detent means for the platen and allows employment simple reduction gear mechanism. However, employment of the stepping motor will result in an undesired high production cost for a line spacing device since, in addition to a relatively high cost of the stepping motor itself, all of the components of the associated reduction gear mechanism must be very accurately made, and the complexity of the circuit for controlling the stepping motor cannot be eliminated.

SUMMARY OF THE INVENTION

Accordingly, it is an object of the present invention to provide a line spacing device for a typewriter which is simple in construction, reduced in overall size and easy to control and hence can be produced at a significantly reduced cost.

It is another object of the invention to provide a new and efficient line spacing device for a typewriter which can assuredly and effectively feed a typewriter platen by intended line space units with a simplified construction.

It is a further object of the invention to provide a line spacing device which can be advantageously incorporated in typewriters, especially those of the type not having a constantly rotating power shaft.

According to the present invention, a line spacing device for a typewriter essentially includes a bidirectional electric motor, which may preferably be a small DC motor, constantly coupled, by way of a transmission which may be either a gear train or of a belt-and-pulley type, to a rockable member mounted for angular rotation on a shaft of a typewriter platen and mounting thereon a feed pawl which is adapted to cooperate with a ratchet wheel secured to the platen shaft to angularly rotate the platen. The motor is first energized to drive the rockable member to angularly rotate in one direction from a first position to a second position at which it is positively stopped by a stop element against the energization of the motor, and then the motor is energized reversely to drive the rockable member to rotate in the other direction from the second position to the first position where it is stopped by another stop element. The platen is fed while the rockable member is first angularly rotated from the first to the second position.

The line spacing device of the present invention is advantageous in that individual components are simple in construction, easy to make and assemble; the motor may be the small bidirectional electric motors which are available on the market; the transmission does not require high accuracy or precision of components such as spur gears, allowing any backlash which can be normally found in conventional transmission gears; and it can be easily incorporated in any conventional typewriter or similar platen equipped office machine.

Other objects and advantages of the present invention will become apparent from the following detailed description and accompanying drawings of a preferred embodiment of the invention.

DETAILED DESCRIPTION OF THE INVENTION

Figure 1:
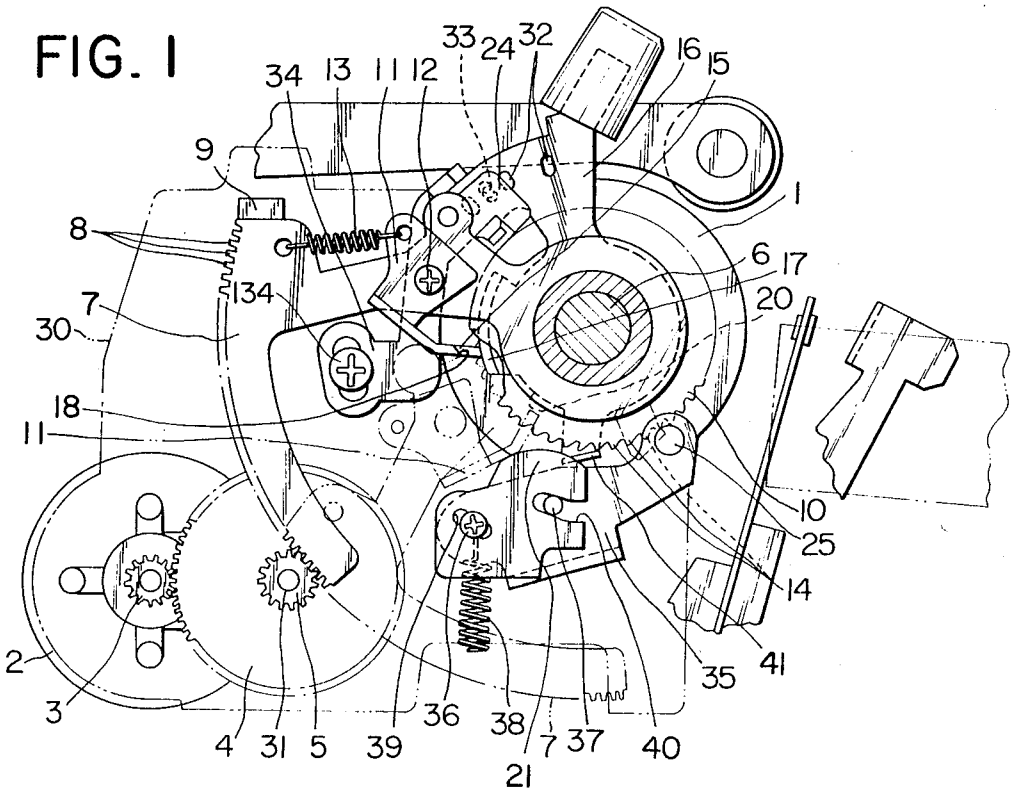
FIG. 1 is a side elevational view, partly broken away and in cross section, of a line spacing device of the present invention.

Referring to FIG. 1, there is illustrated a line spacing device for a typewriter embodying the present invention. The typewriter has a cylinder platen 1 supported at opposite ends thereof for rotation on left and right side walls 30 (only the left one is shown) of a platen frame structure which is suitably secured to a machine frame (not shown).

The line spacing device employs a reversible or bidirectional electric, preferably DC, motor 2 as a driving power source for rotating the cylinder platen 1 to feed a record sheet carried on the platen 1. The motor 2 is mounted on the left side wall 30 and has an output power shaft to which a small spur gear 3 is secured. The gear 3 is in meshed engagement with a large spur gear 4 which is mounted for rotation on a shaft 31 secured to the side wall 30. Another small spur gear 5 which is integral with the gear 4 is in meshed engagement with a toothed periphery 8 of a rockable member 7 in the form of a sector gear mounted for angular rotation on a shaft 6 of the platen 1. Thus, the motor 2 is constantly coupled to the rockable member 7 by way of a transmission gear including the spur gear 3 on the motor shaft, the gears 4 and 5 on the intermediate shaft 31, and the toothed periphery of the sector gear 7. Accordingly, if the motor shaft rotates in the counterclockwise direction in FIG. 1, the intermediate shaft 31 is rotated in the clockwise direction to rotate the sector gear 7 in the counterclockwise direction. On the contrary, if the motor rotates in the opposite clockwise direction, the intermediate shaft 31 is rotated reversely in the counterclockwise direction to rotate the sector gear 7 in the clockwise direction.

A feed pawl 11 is mounted for pivotal motion on the sector gear 7 by means of a pin 12 and has an end edge 18 located in register with a ratchet wheel 10 which is mounted for integral rotation on the platen shaft 6. The feed pawl 11 is urged in the counterclockwise direction about the pin 12 by a tension coil spring 13 extending between the sector gear 7 and the feed pawl 11 so that the end edge 18 thereof is, when allowed, engaged with one of teeth 14 of the ratchet wheel 10. The feed pawl 11 has an extension 15 adjacent the end edge 18 thereof in an axial direction of the platen 1. The extension 15 of the feed pawl 11 is located in register and normally engaged with a cam lobe or larger diameter section 17 of a line space selector lever 16 to hold the feed pawl 11 to its initial position in which the end edge 18 thereof is out of engagement with the ratchet wheel 10 as seen in FIG. 1. The line space selector lever 16 is rotatably mounted on the platen shaft 6 and has a series of holes 32 formed in an arcuate row therein and adapted to be engaged by a dowel 33 formed adjacent one end of a detent member 34 in the form of a spring plate 34 to allow the line space selector lever 16 to be adjusted and retained to any of the angular positions as determined by the detent holes 32 thereof. The spring plate 34 has the opposite end thereof fixed to the side wall 30 by a fastening screw 134.

The line spacing device further includes two stops for positively limiting a rocking motion or angular rotation of the rockable member 7 in opposite directions. A first stop element 9 is secured to the side wall 30 and defines a home or initial position of the rockable member 7 such that, during a clockwise rotation of the rockable member 7, it is abutted against and stopped at its home position by the first stop element 9.

A second stop element is designated by reference numeral 21. The second stop element 21 is secured to a detent lever 35 by means of a fastening screw 36. The detent lever 35 is pivotally mounted on a shaft 37 secured to the side wall 30. The detent lever 35 has a pin 25 secured to one end thereof and is urged in the counterclockwise direction about the shaft 37 by means of a tension coil spring 38 such that the pin 25 of the detent lever 35 is engaged between adjacent teeth 14 of the ratchet wheel 10 to retain the ratchet wheel 10 to any of angular positions determined by the teeth 14 thereof. The second stop element 21 is positioned such that, during a counterclockwise rotation of the rockable member 7 from its home position, the feed pawl 11 thereon is abutted against the second stop element 21 to stop the rockable member 7 at a rotated limit position as shown by the two dots and dash line in FIG. 1. In order to allow an angular adjustment of the rotated limit position of the rockable member 7, the second stop element 21 has an elongated hole 39 and a slot 40 formed in a concentrical relationship therein with their centers coincided with the center of the platen shaft 6, and the screw 36 and the shaft 37 extend respectively through the hole 39 and the slot 40 so that the second stop element 21 can be adjusted relative to the detent lever 35 and hence adjusted angularly about the center axis of the platen cylinder 6.

Figure 3:
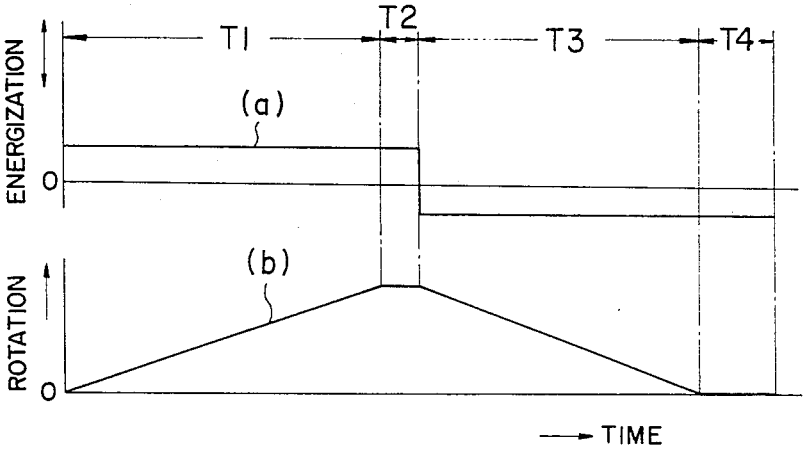
FIG. 3 is a diagrammatic representation showing operations of the line spacing device of FIG. 1.

Now, reference is also made to FIG. 3 in which there is illustrated an operational relationship between the bidirectional electric motor 2 and the rockable member 7 of the line spacing device. In the first step of operation, the motor 2 is energized to rotate the rockable member 7 from the home position to the rotated limit position as stopped by the second stop element 21. In order to assure that the rockable member 7 will be stopped positively at the rotated limit position, the duration of such energization of the motor 2 is selected to be T1+T2, where T1 is a period of time which is normally required for the motor 2 to drive the rockable member 7 to rotate from the home position to the rotated limit position, and T2 is a period of time suitably determined depending upon experiments with a factor of safety taken into account. On the other hand, in the second step of operation, the motor 2 is energized reversely to rotate the rockable member 7 from the rotated limit position to the home position as stopped by the first stop element 9. Also, in order to assure that the rockable member 7 is stopped fixedly at the home position, the duration of such reverse energization of the motor 2 is selected to be T3+T4, where T3 is a period of time normally required for the motor 2 to drive the rockable member 7 to rotate from the rotated limit position to the home position, and T4 is a period of time determined similarly to T2, i.e., depending upon experiments. Thus, one cycle of operation of the line spacing device includes two opposite energizations of the motor 2 in two successive steps over a total period of time T1+T2+T3+T4.

During a counterclockwise angular rotation of the rockable member 7 from the home to the rotated limit position, the feed pawl 11 at first rides on the cam lobe 17 of the line space selector lever 16 and is held thereby in its angular home position as shown in FIG. 1 against the urging of the spring 13. The feed pawl 11 then escapes from the cam lobe 17 into engagement by the extension 15 thereof with a smaller diameter section 20 of the line space selector lever 16 thereby allowing the feed pawl 11 to be pivoted counterclockwise about the pin 12 by the urging of the spring 13 until the end edge 18 thereof is brought into engagement with a tooth 14 of the ratchet wheel 10. Thus, the ratchet wheel 10 and therefore the platen will be rotated by the rockable member 7 in a succeeding remaining fraction of the counterclockwise rotation of the rockable member 7 until the feed pawl 11 is abutted against the second stop element 21 to stop the rockable member 7 at the rotated limit position. As described above, the motor 2 is still energized for some period of time (T2) after the rockable member 7 has reached the rotated limit position.

During a subsequent clockwise angular rotation of the rockable member 7 back to the home position, the end edge 18 of the feed pawl 11 rides on the toothed periphery of the ratchet wheel 10 which is now retained fixed by the engagement of the pin 25 of the detent lever 35 between adjacent teeth 14 of the ratchet wheel 10. Toward the end of the clockwise rotation of the rockable member 7, the extension 15 of the feed pawl 11 is again engaged withe the cam lobe 17 of the line space selector lever 16 and is thereby pivoted clockwise to its initial angular position against the bias of the spring 13.

It can be easily seen that, as in conventional line spacing devices of the type including a feed pawl and a ratchet wheel, a manual displacement of the line space selector lever 16 to a different angular detent position will change the angular position at which the end edge 18 of the feed pawl 11 is brought into engagement with a tooth 14 of the ratchet wheel 10, thereby changing the circumferential distance over which the ratchet wheel 10 and hence the platen 1 are driven by the rockable member 7, that is, the line space amount effected. It should be noted that a displacement of the line space selector lever 16 to the counterclockwise last detent position will cause a bent lug 41 of the lever 16 to be engaged with the pin 25 of the detent lever 35 to bring it out of engagement with the ratchet wheel 10, thereby allowing the platen 1 to be adjusted to any other angular position than the detent positions thereof.

Figure 2:
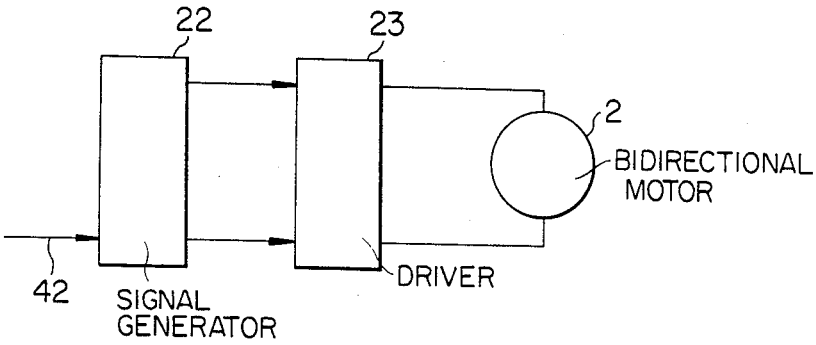
FIG. 2 is a diagrammatic representation of control circuitry for controlling the line spacing device of FIG. 1.

FIG. 2 illustrates, in a diagrammatic representation, exemplary control circuitry for control of the bidirectional motor 2. The control circuitry may include a drive signal generating circuit 22 and a driver circuit 23. When a line spacing instruction is received over a line 42, for example, from a switch associated with a carrier return key, the circuit 22 will provide a first pulse signal having a time constant T1+T2 (FIG. 3) from a first output thereof and then, at the end of the first pulse signal, a second pulse signal having a time constant T3+T4 from a second output thereof. The circuit 22 may, for example, include two one shot multivibrators with an output of one connected to an input of the other. The driver circuit 23 will energize the motor 2 in accordance with the first and second signals thus received from the drive signal generating circuit 22.

It is contemplated that various changes or modifications to the aforedescribed device may be made by one skilled in the art without departing from the basic concept of the present invention. For example, while the aforedescribed device employs a transmission including three spur gears and a sector gear for transmitting the output power of the motor to the rockable member, a transmission including one or more belts and pulleys may otherwise be employed for the driving couple. Furthermore, while the rockable member of the aforedescribed device is stopped at the rotated limit position by a stop element which is abutted by the feed pawl mounted on the rockable member, the stop element may otherwise be located so as to be abutted by the rockable member itself, thus eliminating the feed pawl from being damaged or broken due to abutment against the stop element.

Various other modifications, alternatives, variations, etc., to the embodiment of the device of the present invention may become apparent to one skilled in the art without departing from the spirit and scope of the invention defined by the appended claims.

We claim:

1. In a line spacing device for a machine of the type having a ratchet wheel secured to a shaft of a rotatable platen and a feed pawl cooperative with said ratchet wheel to angularly rotate said platen about an axis thereof for line spacing operation, the improvement which comprises:

a rockable member mounted for angular rotation on the platen shaft and mounting said feed pawl thereon;

a first stop element mounted fixedly relative to said axis of said platen for limiting angular rotation of said rockable member in a first direction;

a second stop element mounted fixedly in a different angular position from said first stop element relative to said axis of said platen for positively limiting angular rotation of said rockable member in a second direction, opposite said first direction;

a bidirectional electric motor; and a transmission constantly coupling said motor to said rockable member, whereby said motor is first energized to drive said rockable member to angularly rotate from a first position limited by said first stop element to a second position limited by said second stop element so as to angularly rotate said ratchet wheel through said feed pawl thereon and then energized to drive said rockable member to rotate from said second to said first position.

2. A line spacing device as claimed in claim 1, wherein said bidirectional electric motor is a small DC motor.

3. A line spacing device as claimed in claim 1, wherein said second stop element is disposed for engagement either with said rockable member or with said feed pawl on said rockable member.

4. A line spacing device as claimed in claim 1, wherein said second stop element is mounted for adjustment relative to said axis of said platen.

5. A line spacing device as claimed in claim 1, wherein said transmission is either of the type including one or more toothed gears or of a belt-and-pulley type.

6. A feeding device for feeding a member of an office machine step by step comprising:

a ratchet wheel mounted for rotation around a longitudinal axis of said member and operatively coupled to said member;

a rockable member mounted for angular rotation around said axis;

a feed pawl mounted on said rockable member and operable upon angular rotation of said rockable member to angularly rotate said ratchet wheel;

a first stop element fixedly mounted relative to said axis for limiting angular rotation of said rockable member in a first direction;

a second stop element fixedly mounted in a different angular position from said first stop element relative to said axis for positively limiting an angular rotation of said rockable member in a second direction opposite said first direction;

a bidirectional electric motor; and a transmission constantly coupling said motor to said rockable member, whereby said motor is first energized to drive said rockable member to rotate by a predetermined angle in said second direction from a first position limited by said first stop element to a second position limited by said second stop element so as to angularly rotate said ratchet wheel through said feel pawl thereon and then energized reversely to drive said rockable member to rotate by the predetermined angle in said first direction from said second to said first position.

7. A feeding device as set forth in claim 6, wherein said bidirectional electric motor is a small DC motor.

8. A feeding device as set forth in claim 6, wherein said second stop element is disposed for engagement either with said rockable member or with said feed pawl on said rockable member.

9. A feeding device as set forth in claim 6, wherein said second stop element is mounted for adjustment relative to said fixed axis.

10. A feeding device as set forth in claim 6, wherein said transmission is either of the type including one or more toothed gears or of a belt-and-pulley type.

11. A feeding device as set forth in claim 6, further comprising adjustable means for holding said pawl from acting on said ratchet wheel for a partial rotation of said rockable member in said second direction so as to allow said ratchet wheel to be rotated by said pawl over an adjusted angle smaller than the predetermined angle.

12. A feeding device for feeding a member of an office machine step by step comprising:

a ratchet wheel mounted for rotation around a longitudinal axis of said member and operatively coupled to said member;

a rockable member mounted for angular rotation around said axis;

a feed pawl mounted on said rockable member and operable upon angular rotation of said rockable member to angularly rotate said ratchet wheel;

first stop means fixed relative to said axis for limiting an angular rotation of said rockable member in a first direction;

second stop means fixed in a different angular position from said first stop means relative to said axis for positively limiting an angular rotation of said rockable member in a second direction opposite said first direction;

drive means coupled to said rockable member, and means for actuating said drive means to rotate by a predetermined angle said rockable member from a first position limited by said first stop means to a second position limited by said second stop means so as to angularly rotate said ratchet wheel through said feed pawl thereon and then reversely to drive said rockable member to rotate by the predetermined angle from said second to said first position.

13. A feeding device as set forth in claim 12, wherein said means for actuating said drive means includes a bidirectional direct current electric motor.

14. A feeding device as set forth in claim 13, together with means for selectively energizing said motor to rotate in said first or second direction.

15. A feeding device as set forth in claim 14, wherein said selective energizing means includes means for providing a first pulse signal having a time constant T1 plus T2 and a second pulse signal having a time constant T3 plus T4.

16. A feeding device as set forth in claim 15, wherein said first pulse signal and said second pulse signal are of opposite polarity.

17. A feeding device as set forth in claim 16, wherein said second stop means is disposed for engagement with said feed pawl on said rockable member.

18. A line spacing device as claimed in claim 17, wherein said second stop means is mounted for adjustment relative to said axis.

19. A feeding device as set forth in claim 18, including adjustable means for holding said pawl from acting on said ratchet wheel for a partial rotation of said rockable member so as to allow said ratchet wheel to be rotated by said pawl over an angle smaller than the predetermined angle.

* * * * *